US008151416B2

(12) United States Patent
Aldred

(10) Patent No.: US 8,151,416 B2
(45) Date of Patent: Apr. 10, 2012

(54) HINGE WITH INTEGRAL LOCKING MECHANISM

(75) Inventor: Darren Aldred, Morristown, TN (US)

(73) Assignee: Meco Corporation, Greeneville, TN (US)

( * ) Notice: Subject to any disclaimer, the term of this patent is extended or adjusted under 35 U.S.C. 154(b) by 408 days.

(21) Appl. No.: 12/337,031

(22) Filed: Dec. 17, 2008

(65) Prior Publication Data

US 2009/0158557 A1 Jun. 25, 2009

Related U.S. Application Data

(60) Provisional application No. 61/015,016, filed on Dec. 19, 2007.

(51) Int. Cl.
*E05D 11/06* (2006.01)

(52) U.S. Cl. ..... 16/374; 16/324; 16/319; 16/335

(58) Field of Classification Search ..... 16/374–377, 16/321, 324, 326, 389, 335; 220/831–834; 297/361.1, 378.1, 378.11–378.14; 108/67, 108/68, 117, 115, 128

See application file for complete search history.

(56) References Cited

U.S. PATENT DOCUMENTS

| | | | | | |
|---|---|---|---|---|---|
| 539,741 | A | * | 5/1895 | Ingram | 16/277 |
| 774,409 | A | * | 11/1904 | Wise | 16/335 |
| 1,423,513 | A | * | 7/1922 | Brown | 16/374 |
| 1,514,917 | A | * | 11/1924 | Lotz | 16/335 |
| 1,555,896 | A | * | 10/1925 | Webster | 16/335 |
| 2,064,839 | A | * | 12/1936 | Kroll et al. | 16/324 |
| 2,798,249 | A | * | 7/1957 | Lukala | 16/326 |
| 2,971,803 | A | * | 2/1961 | Wallin | 16/326 |
| 3,228,058 | A | * | 1/1966 | MacDonald | 16/335 |
| 3,432,879 | A | * | 3/1969 | Arias, Jr. et al. | 16/336 |
| 5,784,758 | A | * | 7/1998 | Carrick | 16/335 |

FOREIGN PATENT DOCUMENTS

GB 2049025 A * 12/1980

* cited by examiner

*Primary Examiner* — Chuck Y. Mah
(74) *Attorney, Agent, or Firm* — McGuireWoods LLP

(57) ABSTRACT

A hinge for use in, e.g., folding tables, folding chairs, or folding shelves that can be locked in at least one position. According to an aspect of the invention, the hinge is locked in the position that would correspond to the open or deployed state of the piece of furniture of which it is a part.

15 Claims, 5 Drawing Sheets

HINGE WITH INTEGRAL LOCKING MECHANISM

CROSS-REFERENCE TO RELATED APPLICATIONS

This application claims priority under 35 U.S.C. §119(e) to provisional U.S. Patent Application No. 61/015,016, filed on Dec. 19, 2007, the disclosure of which is expressly incorporated by reference herein in its entirety.

BACKGROUND OF THE INVENTION

1. Field of the Invention

The invention is directed generally to a hinge used in folding chairs, tables, furniture in general, and the like, especially one that is capable of locking in the "open" or deployed position. In particular, the invention is directed to a locking hinge where the locking mechanism is an integral part of the hinge itself.

2. Related Art

Collapsible furniture, such as, e.g., folding tables, folding chairs, and folding shelves, makes use of hinges and frequently must be locked in an "open" position when the furniture is in its expanded or deployed state. Typically, this is done with a leg lock that props the sections attached to the hinge apart and prevents them from folding in towards each other. While it is generally effective, the lock adds an extra part to the design of the furniture. Thus, it adds to overall weight and assembly time and offers another point in the assembly process at which the user may make a mistake. Moreover, such lock structures are unattractive structures that extend obstructively under the furniture. These obtrusive locks may be easily damaged by users due to their position and may also be obtrusive to users during setup and/or use.

Accordingly, there is a need for a hinge that provides its own integral locking mechanism, is attractive, and/or is not obtrusive.

SUMMARY OF THE INVENTION

The invention meets the foregoing need and provides a hinge with an integral locking mechanism that is easy to operate and that furthermore includes other advantages apparent from the discussion herein.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and the various ways in which it may be practiced. In the drawings.

DETAILED DESCRIPTION OF THE INVENTION

Figure 1:
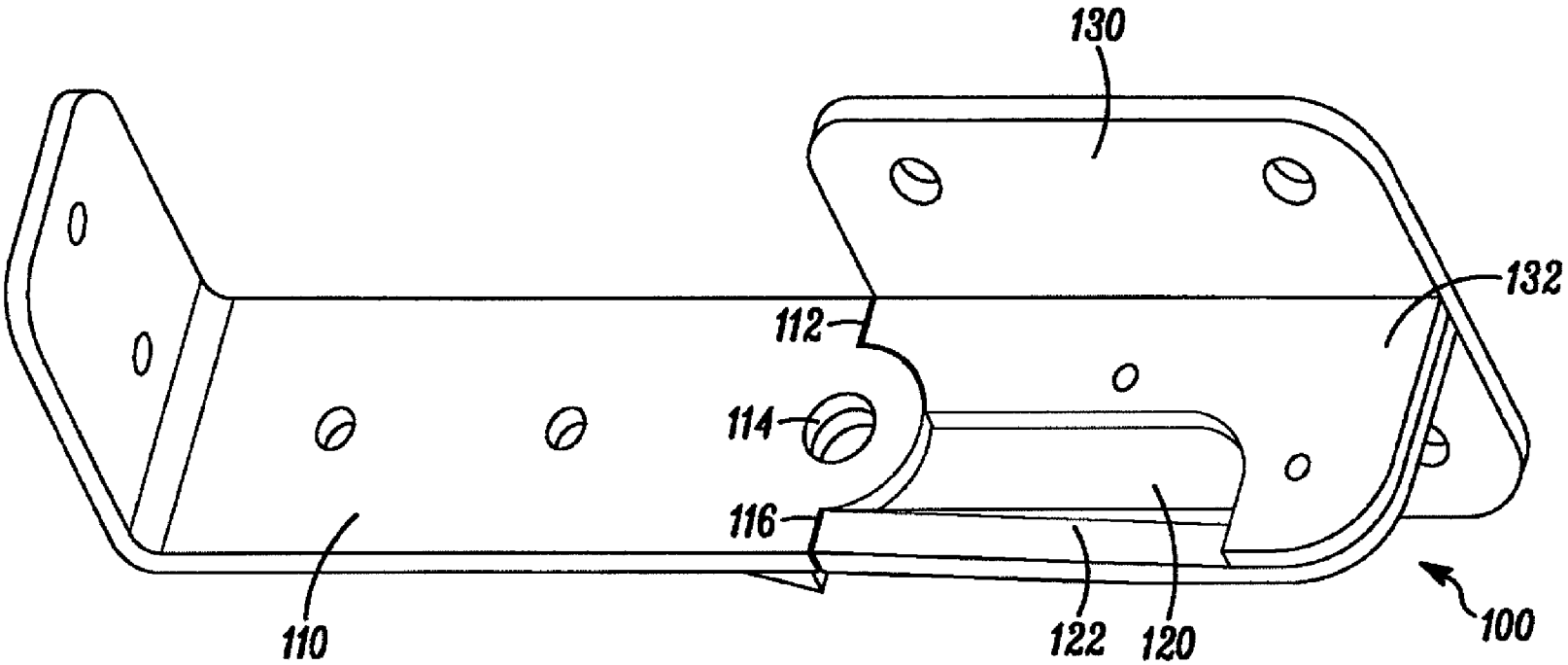
FIG. 1 shows one aspect of the invention with the hinge in the "open" and locked position.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein.

In an aspect of the invention, a hinge 100 may be fashioned from three separate parts: an arm 110, a body 120, and a top 130. The top 130 and the body 120 may be fixedly held together by any known fastener or construction, e.g. rivets or welding. They may also be integrally formed. The body 120 and the arm 110 may be joined at a rotating joint 114. The rotating joint 114 may be any known construction, including, e.g., pivots, pins and so on. The top 130 may be generally at a right angle to the body 120 and arm 110 but may have a lower portion 132 that lies in the same plane as the arm 110. The body 120 may occupy a plane parallel to that of the arm 110 and lower portion 132 except for a locking arm 122, which, in its resting position, is angled such that it terminates in the plane of the arm 110. In particular, locking arm 122 may be formed such that it elastically moves to the plane of the arm 110. This elastic movement may be achieved by any means known to one skilled in the art, such as, e.g., an external spring (not shown), the forged shape of body 120, or the like. Other configurations of the arm 110, body 120, and top 130 are contemplated.

In the open and locked position (see FIG. 1), shoulder 112 contacts the lower portion 132 of top 130, preventing further rotation in a first direction. Shoulder 116 is in contact with the end of the locking arm 122, which is in its resting position with an end in the plane of the arm 110. Contact with the locking arm 122 prevents rotation of the arm 110 in a second direction. Thus the arm 110 is rotationally locked in position relative to the body 120 and top 130.

Figure 2A:
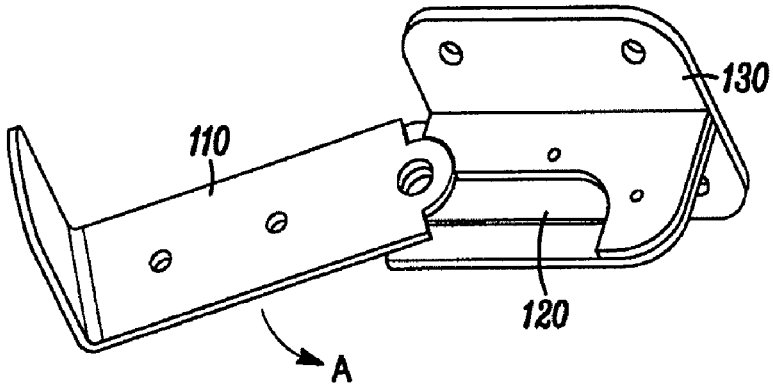
FIGS. 2A, 2B, 2C show the hinge from FIG. 1 at various intermediate stages between the open and closed positions, all of which are unlocked.
Figure 2B:
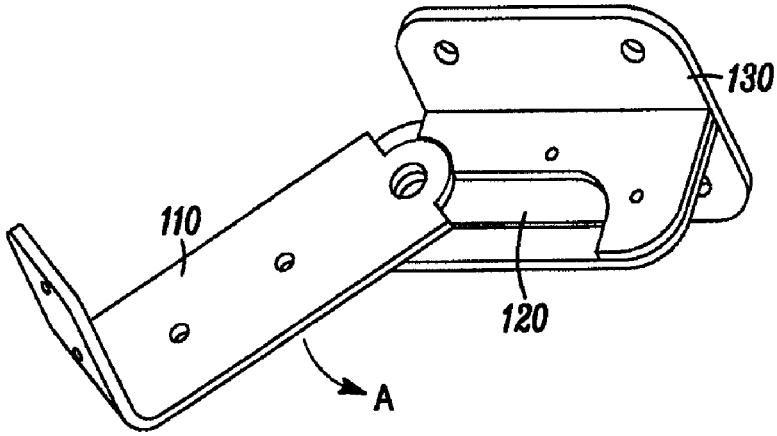
Figure 2C:
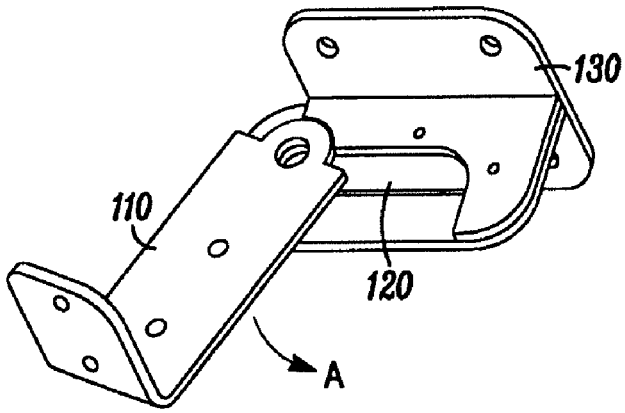
Figure 3:
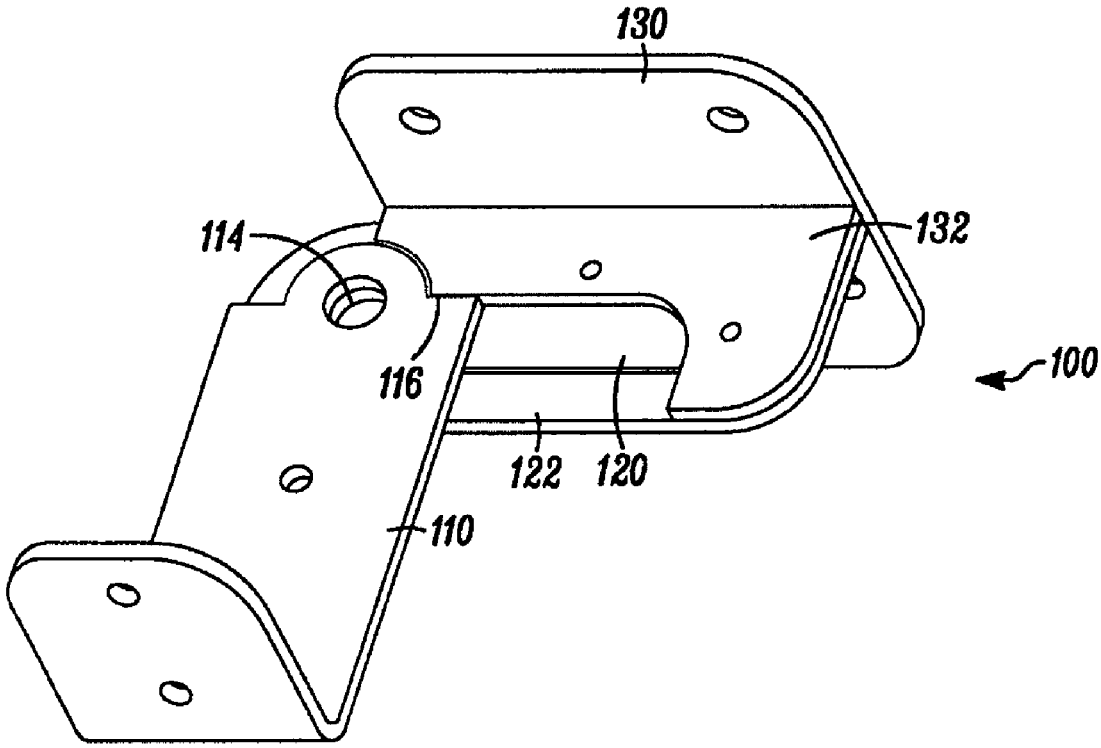
FIG. 3 shows the hinge in the unlocked and closed position.

By moving the end of locking arm 122 substantially into the plane of the body 120, the arm 110 may be unlocked and able to move in the second direction (as indicated by arrow A in FIGS. 2A, 2B, and 2C) until shoulder 116 contacts the lower portion 132 of top 130, preventing further rotation. This is the closed or "unlocked" position. Since, in this embodiment, there is no mechanism to lock the arm 110 in the closed position, the arm 110 may rotate in the first direction until shoulder 112 contacts top 130 and the locking arm 122 moves back to its resting position and locks the arm 110 in the open position.

Body 120 may also have another locking arm portion (not shown) that may engage the arm 110 when in the closed position to provide a locked closed arrangement as well. This locking arm portion may be configured similarly to the arrangement of locking arm 122 and shoulder 116, although other configurations are contemplated and within the scope of the invention.

Figure 4:
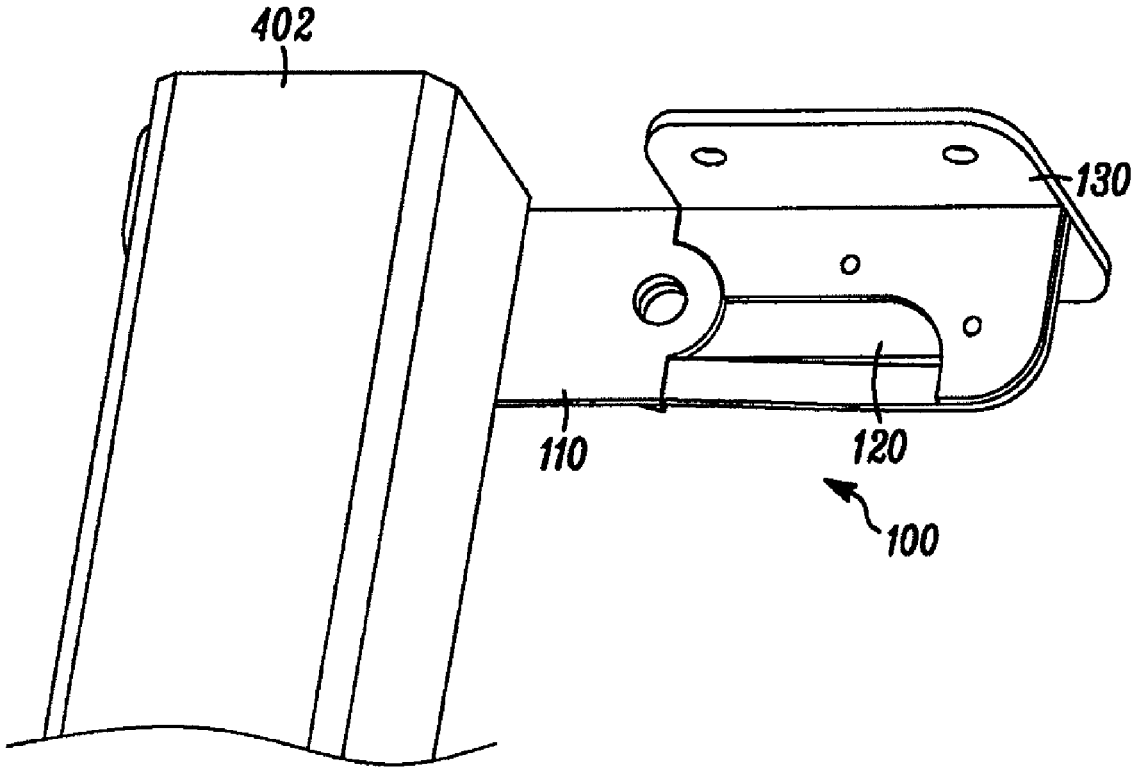
FIG. 4 shows the hinge in the open position attached to a piece of furniture structure, e.g., a table leg.
Figure 5C:
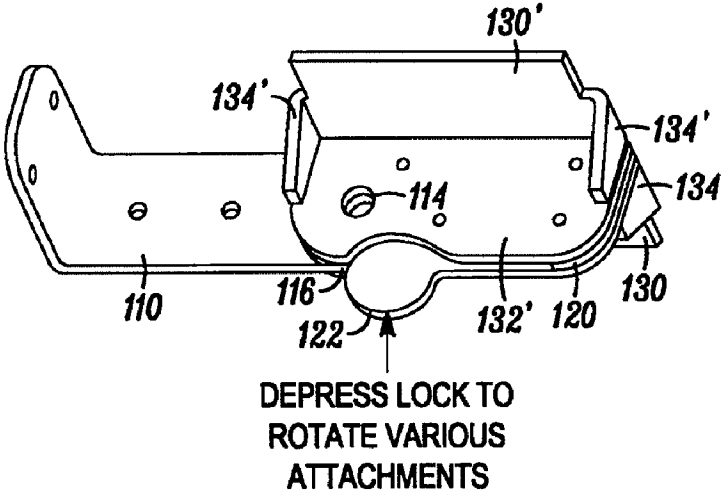
FIGS. 5A, 5B, 5C, 5D show another aspect of the invention.
Figure 5D:
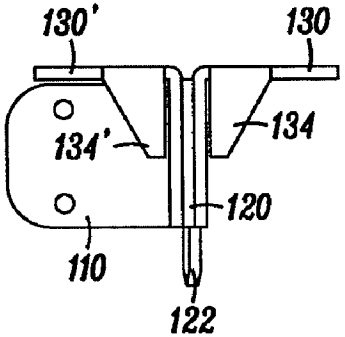
Figure 5A:
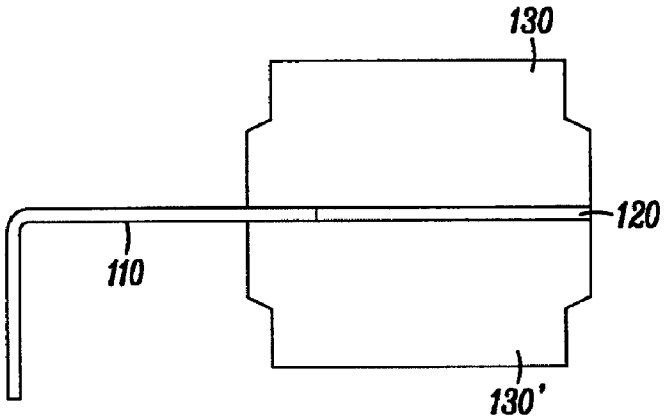
Figure 5B:
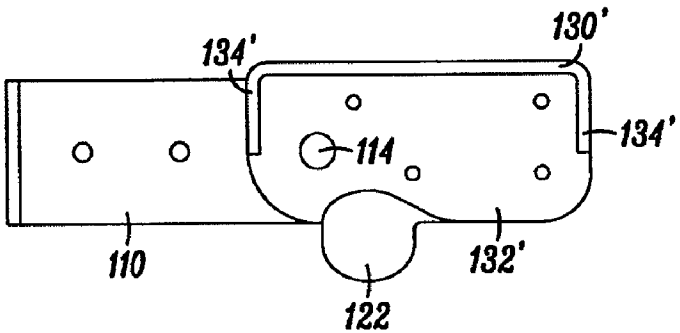

FIG. 4 shows the hinge 100 in conjunction with a furniture leg 402. In particular, the arm 110 may be attached to the leg 402, e.g., with wood screws, locking cams, bolts, or any other known fasteners or construction through various holes (not numbered) in arm 110. The top 130 may, e.g., be attached to a table top (not shown) as part of the assembly of a piece of furniture with at least one folding leg. The top 130 may be attached to the table top with wood screws, locking cams, bolts, or any other known fasteners or construction through various holes (not numbered) in top 130. Of course, the hinge 100 may be used with any type of furniture or apparatus.

FIGS. 5A, 5B, 5C, 5D show another aspect of the invention. In this aspect, the top may be comprised of two pieces 130 and 130', either one or both of which may be connected to the arm 110 at a rotating joint 114. The two-piece construction may provide a stronger arrangement. Moreover, the top 130, 130' may include one or more bent portions that further increase rigidity.

The locking arm 122 may have a circular construction and may be a component of the top 130. The body 120, which may be sandwiched between the top pieces 130 and 130', provides the contact point for the shoulder 112. A shoulder 116 may be formed in arm 110 having a circular surface shape that is complementary to the circular shape of locking arm 122.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications or modifications of the invention.

What is claimed is:

1. A hinge comprising:

a body comprising a locking mechanism, the locking mechanism having a resting position and a depressed position;

a top arranged to form a substantially 90° angle with the body;

a moveable joint connected to the body;

an arm connected to the body with the movable joint, the arm configured to rotate with respect to the body, the arm having a locked position which prevents the arm to rotate relative to the body and an unlocked position which allows the arm to rotate relative to the body, wherein the arm is configured to be held in the locked position by the locking mechanism in the resting position, and the arm is further configured to be moved to the unlocked position when the locking mechanism is moved to the depressed position.

2. The hinge of claim 1, wherein the locking mechanism is configured to release the arm from a locked position when the locking mechanism is in the depressed position, thereby permitting the arm to move to an unlocked position.

3. The hinge of claim 1, wherein the locking mechanism comprises a locking arm.

4. The hinge of claim 1, wherein the movable joint comprises a rotating joint.

5. The hinge of claim 1, wherein the top is configured to be connected to a component of a piece of furniture.

6. The hinge of claim 1, wherein the arm comprises at least one shoulder configured to contact the body, thereby limiting the rotation of the arm in a direction relative to the body.

7. The hinge of claim 1, wherein the arm is configured to be connected to a component of a piece of furniture.

8. A piece of furniture having components connected with the hinge of claim 1.

9. A hinge comprising:

a body defining a first plane, the body comprising a locking mechanism with a moveable end, the locking mechanism having a resting position and a depressed position;

a moveable joint connected to the body;

an arm connected to the body with the movable joint and configured to rotate with respect to the body, the arm defining a second plane parallel to the first plane, the arm occupying a locked position when it is in contact with the locking mechanism in the resting position, the arm further occupying an unlocked position when the locking mechanism is in the depressed position; and the movable end configured to be substantially out of the first plane and substantially in the second plane in the resting position, the movable end further configured to be substantially in the first plane and substantially out of the second plane in the depressed position.

10. The hinge of claim 9, wherein the locking mechanism is configured to release the arm from a locked position when the locking mechanism is in the depressed position, thereby permitting the arm to move to an unlocked position.

11. The hinge of claim 9, wherein the locking mechanism comprises a locking arm.

12. The hinge of claim 9, wherein the movable joint comprises a rotating joint.

13. The hinge of claim 9, wherein the arm is configured to be connected to a component of a piece of furniture.

14. The hinge of claim 9, wherein the arm comprises at least one shoulder configured to contact the body, thereby limiting the rotation of the arm in a direction relative to the body.

15. A piece of furniture having components connected with the hinge of claim 9.

* * * * *